US005759377A

United States Patent [19]

Damen et al.

[11] Patent Number: 5,759,377

[45] Date of Patent: Jun. 2, 1998

[54] PROCESS FOR DE-SILVERING OF A SILVER-CONTAINING SOLUTION

[75] Inventors: Guy Damen, Dessel; Benny Jansen, Geel; Patrick Mertens, Vrasene; Werner Van de Wynckel, Mortsel; Paul Smet, Wilrijk; Frank Michiels, Arendonk, all of Belgium

[73] Assignee: Agfa-Gevaert, Mortsel, Belgium

[21] Appl. No.: 677,197

[22] Filed: Jul. 9, 1996

Related U.S. Application Data

[60] Provisional application No. 60/003,750 Sep. 14, 1995.

[30] Foreign Application Priority Data

Jul. 15, 1995 [EP] European Pat. Off. ..... 95201953

[51] Int. Cl.[6] ..... C25C 1/20; C25C 7/06

[52] U.S. Cl. ..... 205/83; 205/571; 205/702; 205/771; 204/228; 204/231

[58] Field of Search ..... 205/571, 702, 205/771, 83; 204/228, 231

[56] References Cited

U.S. PATENT DOCUMENTS

| | | | |
|---|---|---|---|
| 3,875,032 | 4/1975 | Thompson | 204/109 |
| 4,377,456 | 3/1983 | DeMeester et al. | 205/566 |
| 5,300,199 | 4/1994 | Fyson | 205/83 |

FOREIGN PATENT DOCUMENTS

| | | |
|---|---|---|
| 1000646 | 12/1986 | Belgium . |
| 0035008 | 9/1981 | European Pat. Off. . |
| 0201837 | 11/1986 | European Pat. Off. . |

*Primary Examiner*—Arun S. Phasge
*Attorney, Agent, or Firm*—Baker & Botts, L.L.P.

[57] ABSTRACT

A silver-containing solution is de-silvered in an electrolytic cell having an anode and a cathode. The diffusion limitation current density of the electrolytic cell is estimated by measuring a current flow there-through and silver is deposited on the cathode at a de-silvering current density which is lower than the diffusion limitation current density.

19 Claims, 3 Drawing Sheets

PROCESS FOR DE-SILVERING OF A SILVER-CONTAINING SOLUTION

This application claims the benefit of US Provisional Application No. 06/003,750 filed Sep. 14, 1995.

DESCRIPTION

FIELD OF THE INVENTION

The present invention relates to a process and apparatus for the electrolytic recovery of silver from solutions containing silver, in particular used photographic solutions such as fixing solutions.

BACKGROUND OF THE INVENTION

Electrolytic silver recovery from used photographic solutions is a common way to extend the life of such solutions.

An apparatus for the electrolytic recovery of silver from solutions containing silver is known from European patent application EPA 93200427.8 (Agfa-Gevaert NV) filed 16 Feb. 1993. The apparatus comprises an electrolytic cell having an anode and a cathode, and electrical power supply control means for controlling the supply of electrical power to the anode and the cathode.

The control of the electrochemical process taking place at the anode and the cathode is important in the silver recovery process. If too high a potential difference is applied, side reactions can occur, depending upon the nature of the silver-containing solution, leading to unwanted by-products.

The conditions required for optimum de-silvering depend upon a number of factors including the cathode potential the concentration of silver in the silver-containing solution, the pH of the silver-containing solution (usually within the range of from 3.5 to 6.0) and the condition of the cathode. For a given silver concentration, pH and cathode condition, there is an ideal cathode potential, or narrow range of cathode potentials, which provides fast deposition, good adherence of the silver to the cathode and a low level of side reactions. Outside these optimum conditions, these objectives may not reliably be met. As the de-silvering process continues, the concentration of silver in the silver-containing solution changes as silver is deposited and fresh solution is added, the pH of the solution is unknown or varies in an unpredictable manner and the condition of the cathode may change. It has not therefore been possible to set the electrolytic cell to the optimum de-silvering conditions and to maintain optimum conditions as the de-silvering continues.

There are a number of known methods of controlling the de-silvering process, referred to herein as (i) galvanostatic, (ii) constant potential difference and (iii) potentiostatic.

In galvanostatic control, a constant current flows through the cell while it is in operation. As the de-silvering progresses, the level of silver in the solution falls and the ohmic resistance between the anode and the cathode increases. It is therefore necessary to increase this potential difference in order to maintain a constant current. While the instrumentation required for this control is very simple, the method suffers from the fact that at high silver concentrations the potential difference is small and therefore de-silvering takes place only slowly, while at low silver concentrations the potential difference is sufficiently high that undesirable side reactions are liable to occur, adhesion of the silver to the cathode is bad and sulphidation of the cathode occurs.

In a constant potential difference control method, the potential difference between the anode and the cathode is kept constant as the de-silvering progresses. The disadvantage of this method is that the potential difference between the cathode and the solution is not controlled. The electrochemical reactions taking place at the cathode are therefore uncontrolled, depending on a large number of factors such as the size of the anode, agitation in the neighbourhood of the anode, the presence or absence of components in the solution which can be oxidised and the ease with which they can be oxidised (e.g. $SO_3^-$ and $S_2O_3^-$), the ohmic potential drop in the cell and therefore also the cell geometry and current density, and the current through the cell.

In potentiostatic control, a reference electrode is included in the electrolytic cell and the potential difference between the cathode and the reference electrode is kept constant. This allows complete control over the cathode potential. This method of operation is therefore widely preferred, since it is the cathode potential which determines electrochemical reactions which take place in a fixer of a certain composition. By using a reference electrode, the influence of the anode potential (and largely also the ohmic potential contributions) are excluded. This enables the initial cathode potential to be at a level where bad silver adhesion, side reaction and sulphiding of the cathode can be avoided, independently of the anode potential. The use of a reference electrode makes the equipment more reliable, since factors such as the current density at the anode, the surface state of the anode, over-potential at the anode (caused by changes in solution composition), and ohmic potential drops no longer influence the cathode potential. As the de-silvering process continues and silver is removed from the solution, the current through the cell falls while the potential difference between the cathode and the reference electrode is maintained at a fixed level. When fresh solution with a higher silver content is subsequently added, the current through the cell will normally increase and silver continues to be deposited on the cathode.

The advantage of potentiostatic control has long been recognised (see for example French patent FR 1357177 (Bayer) and it is also used in commercial equipment (e.g. ECOSYS F08, ECOMIX and ECORAP 72/51 ex Agfa-Gevaert Nevertheless, while the initial conditions may be optimum, there is a drift away from optimum conditions as the de-silvering process continues or as processing parameters vary, for example as the silver concentration falls, usually resulting in poor adhesion of the deposited silver to the cathode and/or slower deposition.

The de-silvering process proceeds by depositing silver upon the cathode. If the silver does not adhere strongly to the cathode, there is a risk that it will become detached therefrom, especially as the weight of silver deposited increases and especially in continuously operated cells which have a constant flow of electrolyte solution passing over the cathode. The detached silver may fall to the bottom of the cell where it eventually builds up to a level which may cause a short circuit between the anode and the cathode. Alternatively or additionally the detached silver is flushed out of the cell with the electrolyte liquid. In either case the de-silvering of the solution is not optimally achieved. Optimum user-friendliness is only achievable when the deposited silver is well attached to the cathode.

Furthermore, the potentiostatic control takes no account of all the changes which may occur in the condition of the cathode. In practice, it is sometimes observed that, although the silver content of the bath to be de-silvered is high (for example b >3g/1) and the de-silvering apparatus as such is working correctly, no silver becomes deposited on the cathode. This last effect is thought to be due to "cathode poisoning". Poisoning occurs when components present in the solution block the cathode reduction process. Not all cases of cathode poisoning are understood, but certain components which are present in the developer or which are flushed out of the film may be the cause. A number of photographic stabilisers exhibit this effect, such as PMT (phenyl mercapto tetrazol).

European patent application EP-A-201837 (Kodak-Pathe) describes the electrolytic recovery of silver in a cell which is operated at the plateau of the potential difference/current curve for the cell, that is at that point where the current is determined by the speed of diffusion (migration or mass transport) of silver to the cathode surface. This condition is referred to herein as the diffusion limitation current.

We have found however that, contrary to the teaching of EP-A-201837, operating the cell at the diffusion limitation current results in poor silver adhesion.

SUMMARY OF THE INVENTION

It is an object of the present invention to provide a process for the de-silvering of silver-containing solutions in which the above mentioned disadvantages are minimised.

We have now discovered that the optimum current for obtaining good silver adhesion, while not corresponding to the diffusion limitation current, is nevertheless related thereto, and in particular that the optimum current is less than the diffusion limitation current.

Thus according to a first aspect of the invention, there may be provided a process for de-silvering a silver-containing solution in an electrolytic cell having an anode and a cathode, characterised by the following steps:

(a) estimating the diffusion limitation current density of the electrolytic cell by measuring a current flow there-through; and (b) causing silver to be deposited on the cathode at a de-silvering current density which may be lower than the diffusion limitation current density.

The invention also provides, according to a second aspect, an apparatus for de-silvering a silver-containing solution comprising an electrolytic cell having an anode and a cathode, characterised by:

(a) means for estimating the diffusion limitation current density of the electrolytic cell by measuring a current flow there-through; and (b) means for causing silver to be deposited on the cathode at a de-silvering current density which may be lower than the diffusion limitation current density.

It has not previously been proposed to estimate the diffusion limitation current density and then to set the de-silvering current density at a level which is related thereto. As stated above, operating the cell at the diffusion limitation current results in poor silver adhesion. Making the cathode potential still more negative may increase the plating speed, but side reactions at the cathode (usually sulphite reduction) begin to occur.

In theory, it is possible to calculate the diffusion limitation current density from data such as silver concentration in the solution, agitation, temperature, cathode surface area etc., but in practice there are a number of uncertainties which make this calculation somewhat unreliable. For example, a reliable measurement of the silver concentration is difficult to carry out in a simple manner and the solution temperature may change. The diffusion limitation current density is greatly dependant upon the surface structure of the cathode. New polished cathodes tend to exhibit lower diffusion limitation current densities than cathodes where silver has already been deposited thereon. The diffusion limitation current density will tend to increase as the silver is being deposited, especially at the beginning of the lifetime of the cathode, but this increase is unpredictable. The surface structure of the cathode is also dependant on the plating history of the cathode. Agitation of the solution may vary with time, especially in practical situations where filters in the solution supply circuit clog over time, supply tubes may bend or kink and as the cathode surface grows the geometry of the cell will change.

The result of these uncertainties is that in the case of conservative judgements being made of the factors involved, an under-calculation of the diffusion limitation current density is likely to be made resulting in the cell being operated at too low a current density, resulting in slow deposition. If, on the other hand, the diffusion limitation current density is overestimated, bad silver adhesion will result.

Steps (a) and (b) of the process are preferably performed in respect of the same cathode surface, it being less preferred that a different cathode or only part of the surface of the cathode be used to estimate diffusion limitation current density. To have the maximum de-silvering speed, it is advisable to measure the diffusion limitation current density on the cathode which is actually used for de-silvering and under the de-silvering conditions. Where the estimate of diffusion limitation current density and the de-silvering use the same cathode surface, then the comparison may be between currents per se rather than current densities. However, should the cathode surface used for estimating the diffusion limitation current density be different from that used for the de-silvering, the comparison needs to be in respect of current densities and the area of the cathode used for de-silvering needs to be known in order to derive the total current which needs to be applied thereto.

There are a number of ways to estimate the diffusion limitation current density of the cell.

Firstly, estimating the diffusion limitation current density of the cell may be carried out by potentiostatically setting the cathode to a predetermined cathode potential and measuring the current flow through the electrolytic cell. In this case, the diffusion limitation current density is estimated by measuring the current density at a specified i.e. predetermined potential. The predetermined cathode potential may be set relative to the anode or, more preferably relative to a third electrode, not being the cathode nor the anode. This third electrode may be a reference electrode. Reference electrodes suitable for use in electrolytic de-silvering include standard calomel type electrodes or Ag/AgCl type electrodes, but we particularly prefer the use of a pH sensitive electrode such as a glass electrode, a hydrogen electrode, a quinhydrone electrode and an antimony electrode, most especially a glass electrode which is relatively maintenance free and which is moreover insensitive to hydrostatic pressure variations. The predetermined cathode potential may be from −510 mV to −590 mV, such as from −530 mV to −560 mV, versus the glass electrode. When set to this potential, the silver plating current will be diffusion limited, except where the pH is low (such as below 4.5) when more negative cathode potentials are preferred. The predetermined cathode potential must not be so negative that substantial side reactions occur, which would lead to an over-estimate of the diffusion limitation current density. Except where the reference electrode is a pH electrode, this is particularly the case for low pH fixers where sulphite reduction tends to occur at less negative cathode potentials. At higher pH values, the sulphite reduction potential is more negative and the sulphite reduction current also tends to be lower. Thus the cathode may be set to a potential where no more than 40%, most preferably no more than 20%, of the current at the cathode may be consumed by side reactions, as measured from the efficiency of the silver deposition process.

When the diffusion limitation current density is estimated by potentiostatically setting the cathode potential to a predetermined value, it is preferable to select a value which is more negative than the de-poisoning potential of the cathode, since otherwise under-estimation of the diffusion limitation current, and therefore too slow de-silvering, may occur. The diffusion limitation current is not substantially affected by poisoning. For each solution, there is a potential at which the current increases sharply, due to de-poisoning of the cathode. This potential is defined as the de-poisoning potential.

In some cases, poisoning will cause the diffusion limitation current density to be under-estimated. This will, for example, be the case when the de-poisoning potential is equal to the cathode potential during the estimation of the diffusion limitation current density. In this case, it may be advisable to apply a short current surge to activate the cathode. This current surge may be applied in the normal plating step, but preferably, it is given during the step where the diffusion limitation current density is estimated. Thus, prior to estimating the diffusion limitation current density of the cell a current surge may be applied to the cathode during which the cathode potential is at least 20 mV more negative than the predetermined cathode potential for a period of less than 10 seconds, most preferably at least 50 mV more negative than the predetermined cathode potential for a period of less than 3 seconds.

Secondly, the diffusion limitation current density may be estimated from the responses to known potential variations applied to the cathode, as described in EPA-201837 referred to above.

Thirdly, the diffusion limitation current density may be estimated from the shape of current-potential curves. This is possible by periodically measuring the current-potential characteristic of the de-silvering cell under actual de-silvering conditions. The current-potential characteristic may be the curve of current versus 1) potential difference between the cathode and a third electrode, 2) potential difference between the cathode and the anode, or 3) the potential difference between the anode and a third electrode not being the cathode. The diffusion limitation current can,for example, be determined by identifying the cell current at the cathode potential when the second derivative of the current-potential characteristic is zero and the first derivative is minimal. In these methods, the third electrode may be a standard calomel electrode or a silver/silver chloride electrode, a pH sensitive reference electrode, especially a glass electrode, or a silver electrode (used for measuring the rest potential). Low maintenance electrodes with good durability are preferred.

Estimating the diffusion limitation current density of the cell may be carried out at a frequency sufficiently high that the silver content of the silver-containing solution falls by less than 50%, most preferably by less than 20%, in the immediately preceding de-silvering step.

The diffusion limitation current density may be estimated from the shape of the curve of current density versus potential difference between the anode and the cathode or from the shape of the curve of current density versus potential difference between the cathode and a third electrode, other than the anode and the cathode.

Estimating the diffusion limitation current density of the cell may be carried out automatically, such as by an intelligent control device which forms part of, or may be connected to the apparatus.

Steps (a) and (b) may be performed alternately, that is, estimation the diffusion limitation current density of the cell may be repeated after each de-silvering step and the sequence may be continued.

The de-silvering current density is lower than the diffusion limitation current density by a predetermined fraction, which may, for example, be from 10% to 90%, such as from 30% to 80% of the diffusion limitation current density.

The de-silvering current may be controlled potentiostatically, that is the de-silvering cathode potential may be so controlled as to not vary by any more than ±15%.

Alternatively, the de-silvering current may be controlled galvanostatically to a substantially stable value, that is the de-silvering current may be so controlled as to not vary by any more than ±20%. Galvanostatic control, or a hybrid of galvanostatic and potentiostatic control, is preferred for two reasons. Firstly, in the case of poisoned cathodes, the current-potential characteristic may be very steep, which makes potentiostatic control liable to instabilities. Secondly, again in the case of poisoned cathodes, diffusion limitation current density is preferably estimated at a potential more negative than the de-poisoning potential, so that there is little or no interference from the poisoning of the cathode. In the case that the de-silvering current density is controlled potentiostatically, it can happen that the cathode starts to poison and that the current drops. In the case of galvanostatic control, the cathode potential will automatically be made more negative as the cathode starts to be poisoned.

In a preferred embodiment of the invention therefore, the control of the de-silvering current density is carried out by a hybrid of potentiostatic and galvanostatic control. After the diffusion limitation current density is estimated, the anode-cathode potential difference is slowly decreased. At the moment when the predetermined fraction (say 60%) of the estimated diffusion limitation current density is reached, the potential is measured and potentiostatic control takes over with the target potential equal to that measured potential. Moreover, every few seconds, such as every 6 seconds, the measured current is compared with the target current (in this case 60% of the diffusion limitation current density). If the current value is too low or too high, the target potential for the potentiostatic control is adjusted accordingly.

The time taken for estimating the diffusion limitation current density of the cell may be from 1 to 25%, such as from 2% to 10%, of the total de-silvering time, that is of the total time taken for both steps (a) and (b).

The silver-containing solution may be selected from photographic fixing and bleach-fixing solutions. The silver concentration in the silver-containing solution is typically from 0.1 g/l to 5 g/l. Where the silver-containing solution is a fixing solution, the process of the invention is particularly effective if the fixing solution has a volume of less than 100 ml/g, most preferably less than 40 ml/g of silver to be fixed thereby, because at low replenishment rates, the importance of unwanted side reactions becomes greater.

The silver-containing solutions which can be de-silvered using the present invention include any solution containing silver complexing agents, e.g. thiosulphate or thiocyanate, sulphite ions and free and complexed silver as a result of the fixing process. The apparatus can also be used with rinsing water or concentrated or diluted used fixing solutions, possibly contaminated with carried-over developer. Apart from the essential ingredients, such solutions will often also contain wetting agents, buffering agents, sequestering agents and pH adjusting agents. The silver-containing solution may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are inter alia the heterocyclic nitrogen-containing compound such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in British patent Nos. GB 1203757, GB 1209146 and GB 1500278 and Japanese patent application No. 75-39537, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are metal salts such as, for example, mercury or cadmium salts and the compounds described in Research Disclosure No. 17643 (1978), Chapter VI.

The process is particularly applicable in cases of low replenishment rates, because components carried over from the developer for example and components which are flushed out of the film (such as stabilizers, surfactants and sensitizers), are more concentrated. In particular, surfactants may aggravate the poisoning effects of stabilizers such as PMT.

The de-silvering process can be carried out batch-wise or continuously, the apparatus being connected to the fixing solution forming part of a continuous processing sequence. The apparatus according to the invention may be designed to be operated manually, automatically or automatically with manual over-ride.

The material used for the anode is not especially critical, although platinated titanium is usually used. Platinum, graphite and nobel metals are alternatives. The anode may be in the form of a rod, located at the axis of the electrolytic cell, where this is in cylindrical form.

The cathode may be formed from a generally flat sheet of flexible material, an electrically conductive surface being provided on one major face thereof, securing means being provided to enable the sheet to be folded into and secured in an open circular cross-sectional configuration. The cathode preferably ideally has a frusto-conical cross-section, with its larger radius end uppermost, that is towards the circular upper opening of the electrolyte cell. This configuration enables easy removal of the cathode even after a silver deposit has built up there-on after use. Usable cathode materials include stainless steel, silver and silver alloys, and other conductive materials, the non-silver containing materials being preferred from the point of view of costs, while the silver containing materials cause fewer starting-up problems.

The positioning of the reference electrode is important to the de-silvering process. While in principle the electrode would be best placed between the cathode and the anode, as close as possible to the cathode, this may cause troubles as more and more silver is deposited on the cathode, which is thus growing thicker. When the reference electrode is placed further from the cathode, say 20 mm therefrom, ohmic potential drops will cause the potentiostatic de-silvering not to be truly potentiostatic. It has therefore been proposed to place the reference electrode on the far side of the cathode from the anode, but close to the cathode. We prefer to place the reference electrode at a distance of 5 mm from the cathode, and the potential difference values quoted herein are based on such a distance. If the reference electrode is placed nearer to or further from the cathode, a appropriate correction needs to be applied. In any event, the reference electrode should preferably be positioned from 1 mm and 50 mm from the cathode, where the potential measured while the cell is in operation, corresponds within 100 mV, preferably within 30 mV, to the potential that would be measured with the reference electrode in front of the cathode.

In one embodiment of the electrolytic cell, the cathode includes an opening extending from the outer face to the inner face, the opening being located in the neighbourhood of the reference electrode to ensure that the reference electrode is located within the electrical field of the cell.

The reference electrode may conveniently be positioned adjacent the outlet port of the cell. The potential at which the reduction of sulphite starts to take place is dependant on the pH of the fixing solution. Therefore, the potential to be used for optimum de-silvering is dependant upon the nature of the fixer used and other parameters such as the pH of the developer bath, the presence or absence of intermediate rinsing, the degree of carry over from the developer to the fixer, and the buffering capacities of the developer and the fixer solutions.

We prefer that the reference electrode is a pH sensitive electrode. A suitable electrode has been disclosed in European patent application EP 598144 (Agfa-Gevaert NV).

In a preferred embodiment of the invention, the electrolytic cell comprises a housing, an anode, a removable cathode and a reference electrode all positioned within the housing. The cathode has an inner face directed towards the anode and an outer face directed towards the reference electrode. In use, silver from the silver containing solution is deposited on the face of the cathode which is directed towards the anode.

In a suitable embodiment of the invention, the electrolytic cell housing is formed of electrically non-conductive material and may be generally cylindrical, although other shapes are possible. A cylindrical shape to the cell enables the cathode to be positioned near to the wall of the housing. The anode has a generally linear configuration axially located within the housing. The cathode has an open circular cross-sectional configuration surrounding the anode. The reference electrode is located in a side arm of the housing. Preferably, the housing further comprises a liquid inlet and a liquid outlet for the electrolyte liquid, predetermining a liquid level within the cell. In an embodiment of the cell, the housing is provided with an electrically conductive contact surface above the liquid level and clamping means serve to clamp a contact portion of the cathode against the contact surface of the housing to complete an electrical connection to the cathode. The contact portion of the cathode should have an electrically conductive surface. The provision of the contact surface in an upper part of the electrolytic cell housing, in particular an annular contact surface, enables this surface to be above the level of the electrolyte in the cell in use, thus reducing the risk of leakage and corrosion.

Where the electrolytic cell includes a liquid inlet and a liquid outlet, the process according to the invention may include the step of continuously supplying silver-containing solution to the cell through the inlet and continuously removing de-silvered solution from the outlet. The silver-containing solution may be supplied to the electrolytic cell at rate of from 5 to 25 l/minute.

BRIEF DESCRIPTION OF THE DRAWINGS

The invention will now be further described, purely by way of example, by reference to the accompanying drawings in which:

As shown in FIG. 1, the apparatus comprises an electrolytic cell 10, formed of electrically non-conductive material such as PVC, and comprising a base 15, sides 16 and an upper portion 17. An electrolyte inlet port 18 is provided towards the bottom of the cell and an electrolyte outlet port 19 is provided towards the top of the cell.

Figure 1:
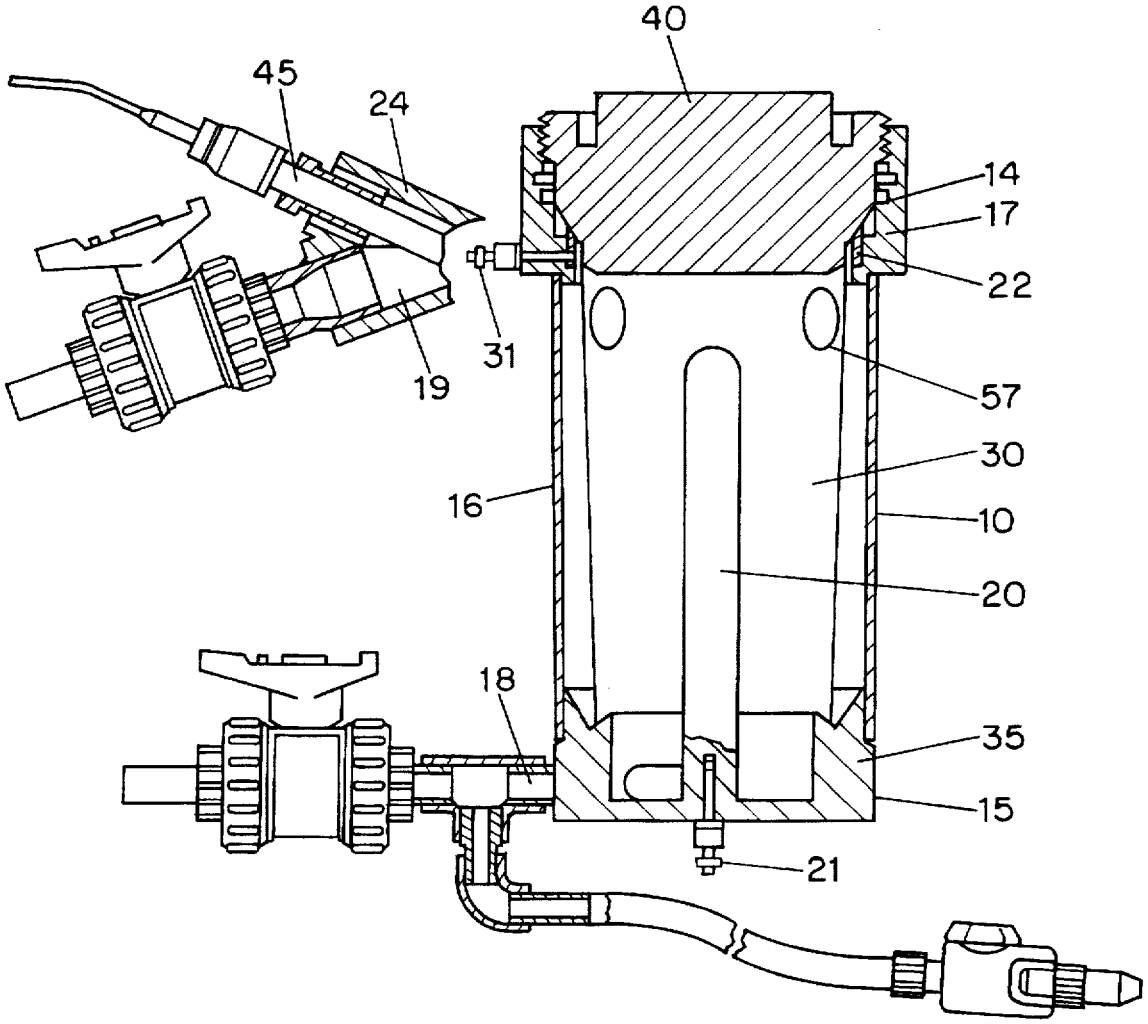
FIG. 1 shows, partly in cross-section, an electrolytic cell for use in accordance with the invention.

An anode 20, in the form of a platinised titanium rod, is secured to the base of the cell by means of a bolt 21 which acts as an electrical connector for the anode. The anode 20 lies along the axis of the cell 10. A reference electrode 45 is positioned in a side arm 24 of the cell 10 and protrudes into the outlet port 19 of the cell. A suitable reference electrode is a pH sensitive glass electrode such as a YOKOGAWA SM21/AG2 glass electrode.

The upper part 17 of the cell is in the form of a neck portion having an opening defined by a stainless steel ring 22. The contact surface of the ring 22 is frustoconically shaped, having its narrower radius downwards. The stainless steel ring 22 is permanently fixed to one end of a bolt 31 which extends through the wall of the cell and provides a connector for the cathode 30. Positioned in the neck of the cell, above the level of the annular ring 22, is a sealing ring 14.

The apparatus further comprises a lid 40 so shaped as to fit into the neck portion of the cell. The lid 40 is formed of electrically non-conductive material such as PVC. The lower portion of the lid 40 is shaped to correspond to the shape of the ring 22.

The cathode 30, formed for example of a flat stainless steel sheet 50 having a thickness of 100 μm, is wrapped around into a frusto-conical configuration, where the upper radius is marginally larger than the lower radius by a factor of 1.05. The cathode 30 has a deformable upper edge portion. The sheet material of which the cathode is formed is sufficiently resilient to allow upper edge portion to bend outwardly in response to outwardly directed force. The deformable upper edge portion of the cathode lies adjacent the stainless steel ring 22. Tightening of the lid causes the upper edge portion of the cathode 30 to be clamped firmly by the lid against the ring 22, thereby establishing good electrical contact there-between.

The cathode is provided with a number of openings 57 which extend therethrough. The cathode 30 is located in the cell 10 with its bottom edge supported by a cathode support ledge 35 in the cell. One of the openings 57 is located in the neighbourhood of the reference electrode 45.

In the closed position of the lid, the sealing ring 14 bears against the outer surface of the lid 40, thereby forming a tight seal. Electrolyte liquid is now fed into the cell by way of the inlet port 18, fills the cell and exits by way of the outlet port 19. The effect of the sealing ring 14 is to prevent the electrolyte level rising above the level of the outlet port 19, so maintaining an air space above the liquid and preventing contact between the liquid and the surface of the ring 22. The risk of corrosion of the latter is thereby reduced and the opening of the cell is made easier because the air space fulfils a compression-decompression function.

Figure 2:
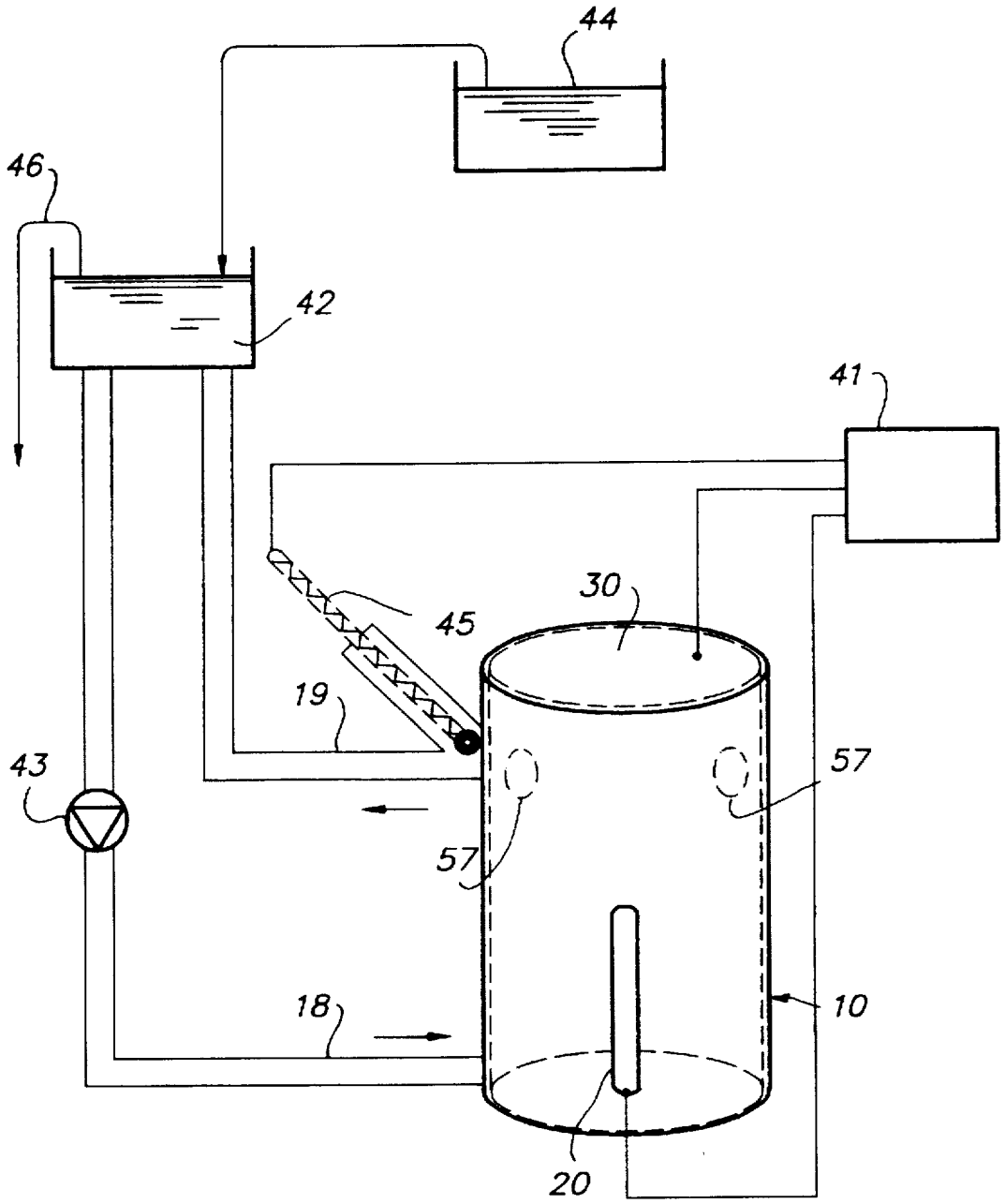
FIG. 2 is a schematic representation of the use of an apparatus according to the present invention.

Referring to FIG. 2 it will be seen that the anode 20, the cathode 30 and the reference electrode 45 of the electrolytic cell 10 are connected to a control device 41 which controls the application of electrical power to the anode and the cathode. The cell 10 is fed with contaminated fixer from a first fixer container 42 via a pump 43 which is provided with a filter (not shown).

The contaminated fixing solution is topped up from time to time with fresh fixing solution from a second fixer container 44, while the total liquid volume is maintained at a constant level by means of an overflow 46.

Figure 3:
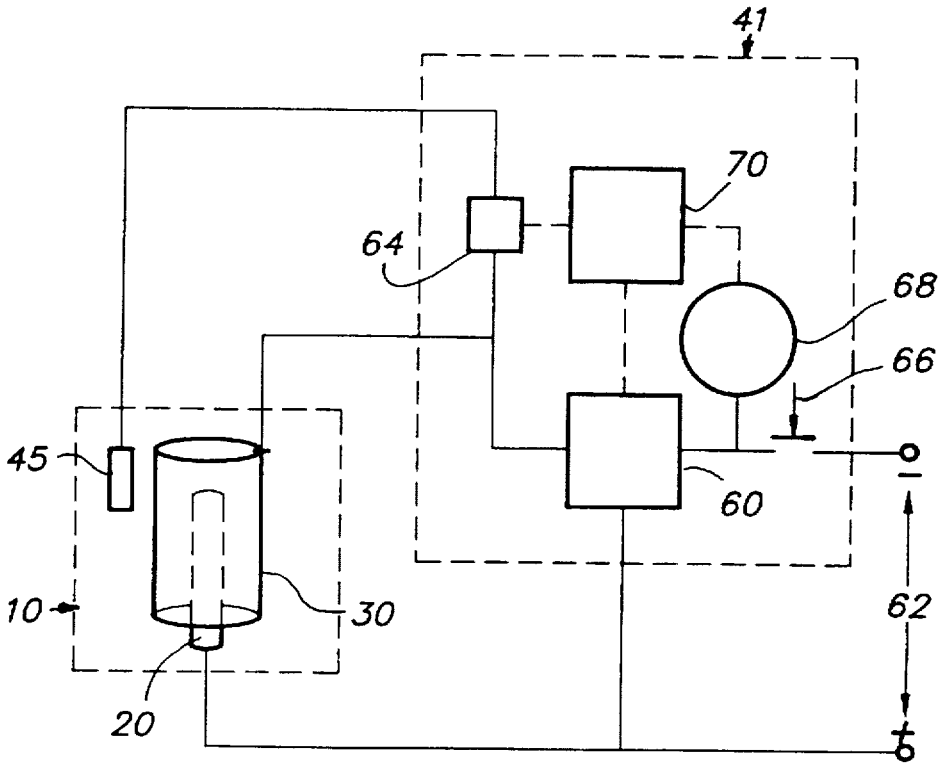
FIG. 3 is a schematic representation of a control circuit for use in the present invention.

FIG. 3 shows the apparatus for de-silvering silver-containing solutions comprising the electrolytic cell 10, the anode 20, the cathode 30 and the reference electrode 45 positioned adjacent the cathode. Electrical power supply control means in the form of the control device 41 is provided for controlling the supply of electrical power to the anode 20 and the cathode 30. The control device 41 includes a potentiometer 60 for adjusting the potential difference applied from a power source 62 between the anode 20 and the cathode 30. A voltage meter 64 measures the potential difference between the cathode 30 and the reference electrode 45 and a current meter 65 measures the current flow through the cell. A start switch 66 initiates the start of a de-silvering process by completing the connection between the power source 62 and the cathode 30. A timer 68 measures the time elapsed from the operation of the start switch 66. A micro-processor 70, or other suitable control circuit, is linked to the voltage meter 64, the current meter 65 and the timer 68 and is programmed to adjust the potentiometer 60 in response to the timer 68, the voltage meter 64 and the current meter 65.

EXAMPLE

The apparatus shown in the Figures is operated as follows. The solution to be de-silvered is a commercially available photographic fixer G333 having a pH of 5.3 which is loaded with 1 g/l silver. A new cathode is used. After the cell is loaded with fixer, the start switch 66 is closed. The micro-processor 70 sets the control device 41 into its diffusion limitation current density estimating mode. The potentiometer 60 is adjusted to apply a predetermined potential of −560 mV to the cathode 30. During this mode the current flowing through the cell, about 2 A, is measured by the current meter 65, which supplies a signal indicative of this diffusion limitation current to the micro-processor 70. The micro-processor 70, having been pre-programmed with the predetermined fraction of say 40%, then calculates the required de-silvering current of 800 mA.

After a period of time of 60 seconds pre-programmed into the micro-processor 70, the latter switches the control device 41 to its de-silvering mode. During the de-silvering mode, the micro-processor 70 initially adjusts the potentiometer 60 to cause the anode-cathode potential difference to be slowly decreased while continuously monitoring the cell current as measured by the current meter 65. When the cell current reaches the calculated de-silvering current of 800 mA at 100 seconds from the start, the micro-processor 70 monitors the cathode potential of −520 mV as measured by the voltage meter 64 and applies potentiostatic control by adjusting the potentiometer 60 to ensure that the cathode potential remains constant at this target value. However, every 6 seconds, the micro-processor 70 monitors the cell current as measured by the current meter 65. As soon as this monitored cell current differs from the calculated de-silvering current of 800 mA, the micro-processor 70 makes an appropriate modification to the target potential and adjusts the potentiometer 60 accordingly.

After a given period of time of 10 minutes pre-programmed into the micro-processor 70, the latter switches the control device 41 to the diffusion limitation current estimating-mode again and the sequence is repeated. The quality of silver adhesion to the cathode is good.

In other experiments, it is found that good silver adhesion can be obtained with a de-silvering current set at up to 90% of the diffusion limitation current, but that at 95% and above the silver adhesion is bad.

On occasions, the frequency of which is pre-programmed into the micro-processor 70, a small surge current of 4.3 amps at −615 mV for 2 seconds is applied. This current surge activates the cathode resulting in a more accurate subsequent estimation of the diffusion limitation current.

For the sake of clarity, potential differences mentioned throughout this specification are, unless otherwise specified, measured with a glass reference electrode, with a potential of +208 mV relative to NHE (normal hydrogen electrode) at pH 7 at room temperature and positioned as described in European patent application EP 598144, referred to above. Where other forms of reference electrode are used, or where the electrodes are positioned in other places in the cell, appropriate modifications of the potential differences referred to herein are necessary, as will be clear to those skilled in the art. In the apparatus according to the invention, the means for estimating the diffusion limitation current density of the electrolytic cell and for causing silver to be deposited on the cathode at a de-silvering current density which may be lower than the diffusion limitation current density may together be constituted by a control circuit which comprises a potentiometer for adjusting the potential difference applied from a power source between the anode and the cathode, a voltage meter which measures the potential difference between the cathode and the reference electrode, and a current meter which measures the current flow through the cell. A microprocessor may be linked to the voltage meter and the current meter and be programmed to adjust the potentiometer as required.

We claim:

1. A process for de-silvering a silver-containing solution in an electrolytic cell having an anode and a cathode, characterized by the following steps:

(a) estimating the diffusion limitation current density of said electrolytic cell by measuring a current flow there-through; and (b) causing silver to be deposited on said cathode at a de-silvering current density which is up to 90% of said diffusion limitation current density.

2. A process according to claim 1, wherein said steps (a) and (b) are performed in respect of the same cathode surface.

3. A process according to claim 1, wherein steps (a) and (b) are performed alternately.

4. A process according to claim 3, wherein step (a) is carried out at a frequency sufficiently high that the silver content of said silver-containing solution falls by less than 50% in the immediately preceding step (b).

5. A process according to claim 1, wherein said de-silvering current is controlled galvanostatically to a substantially stable value.

6. A process according to claim 5, wherein said de-silvering current is controlled potentiostatically.

7. A process according to claim 1, wherein step (a) is carried out by potentiostatically setting said cathode to a predetermined cathode potential and measuring the current flow through said electrolytic cell.

8. A process according to claim 6, wherein step (a) is carried out by potentiostatically setting said cathode to a predetermined cathode potential relative to said anode.

9. A process according to claim 6, wherein step (a) is carried out by potentiostatically setting said cathode to a predetermined cathode potential relative to a third electrode, not being said cathode nor said anode.

10. A process according to claim 9, wherein said third electrode is a reference electrode.

11. A process according to claim 10, wherein said third electrode is a pH sensitive reference electrode.

12. A process according to claim 11, wherein said pH sensitive reference electrode is a glass electrode.

13. An apparatus for de-silvering a silver-containing solution comprising an electrolytic cell having an anode and a cathode, characterized by:

(a) means for estimating the diffusion limitation current density of said electrolytic cell by measuring a current flow there-through; and (b) means for causing silver to be deposited on said cathode at a de-silvering current density which is up to 90 % said diffusion limitation current density.

14. An apparatus according to claim 13, further comprising means for galvanostatically controlling said de-silvering current to a substantially stable value.

15. An apparatus according to claim 13, further comprising means for potentiostatically controlling said de-silvering current to a substantially stable value.

16. An apparatus according to claim 13, further comprising a third electrode, not being said cathode nor said anode.

17. An apparatus according to claim 16, wherein said third electrode is a pH sensitive reference electrode.

18. An apparatus according to claim 17, wherein said pH sensitive reference electrode is a glass electrode.

19. An apparatus according to claims 13, further comprising an intelligent control device for automatically estimating the diffusion limitation current density of said electrolytic cell.

* * * * *